US011396768B2

(12) United States Patent
Juntunen

(10) Patent No.: US 11,396,768 B2
(45) Date of Patent: Jul. 26, 2022

(54) CAM ACTION DOOR CLOSER

(71) Applicant: Abloy Oy, Joensuu (FI)

(72) Inventor: Harri Juntunen, Joensuu (FI)

(73) Assignee: ABLOY OY, Joensuu (FI)

( * ) Notice: Subject to any disclaimer, the term of this patent is extended or adjusted under 35 U.S.C. 154(b) by 0 days.

(21) Appl. No.: 17/193,440

(22) Filed: Mar. 5, 2021

(65) Prior Publication Data

US 2021/0277697 A1 Sep. 9, 2021

(30) Foreign Application Priority Data

Mar. 6, 2020 (EP) ..... 20161454

(51) Int. Cl.
*E05F 3/10* (2006.01)
*E05F 3/12* (2006.01)

(52) U.S. Cl.
CPC ..... *E05F 3/104* (2013.01); *E05F 3/12* (2013.01); *E05Y 2201/254* (2013.01); *E05Y 2900/132* (2013.01)

(58) Field of Classification Search
CPC ..... E05F 3/12; E05F 3/104
See application file for complete search history.

(56) References Cited

U.S. PATENT DOCUMENTS 4,234,996 A * 11/1980 Jentsch ..... E05F 3/102 16/52
4,378,612 A * 4/1983 Beers ..... E05F 3/12 16/49
4,658,468 A * 4/1987 Tillmann ..... E05F 3/104 16/53
4,785,493 A * 11/1988 Tillmann ..... E05F 3/104 16/53
4,793,023 A * 12/1988 Simpson ..... E05F 3/12 16/52
5,193,647 A * 3/1993 O'Brien, II ..... F03G 1/00 185/40 R
5,417,013 A * 5/1995 Tillmann ..... E05F 3/104 16/53
5,502,874 A * 4/1996 Lucas ..... E05F 3/102 16/52
5,802,670 A * 9/1998 Bienek ..... E05F 3/10 16/53
6,442,795 B1 * 9/2002 Chen ..... E05F 3/104 16/49
6,493,904 B1 * 12/2002 Chiang ..... E05F 3/104 16/56

(Continued)

FOREIGN PATENT DOCUMENTS

CN 201705094 U 1/2011
EP 0545624 A2 6/1993

*Primary Examiner* — Jason W San
(74) *Attorney, Agent, or Firm* — Muncy, Geissler, Olds & Lowe, P.C.

(57) ABSTRACT

A cam action door closer comprising a body, a spring, a speed control channel system and a latching control channel system, a closing control piston having a piston head and a circular side. The closing control piston has a cutting on the side of the closing control piston and on the piston head, the cutting forming a control edge at its end. The cutting has a length between the piston head and the control edge. The speed control channel system comprises a speed connecting channel, which is located in such a way that the control edge is arranged to close it.

4 Claims, 2 Drawing Sheets

(56) References Cited

U.S. PATENT DOCUMENTS

Figure 5:
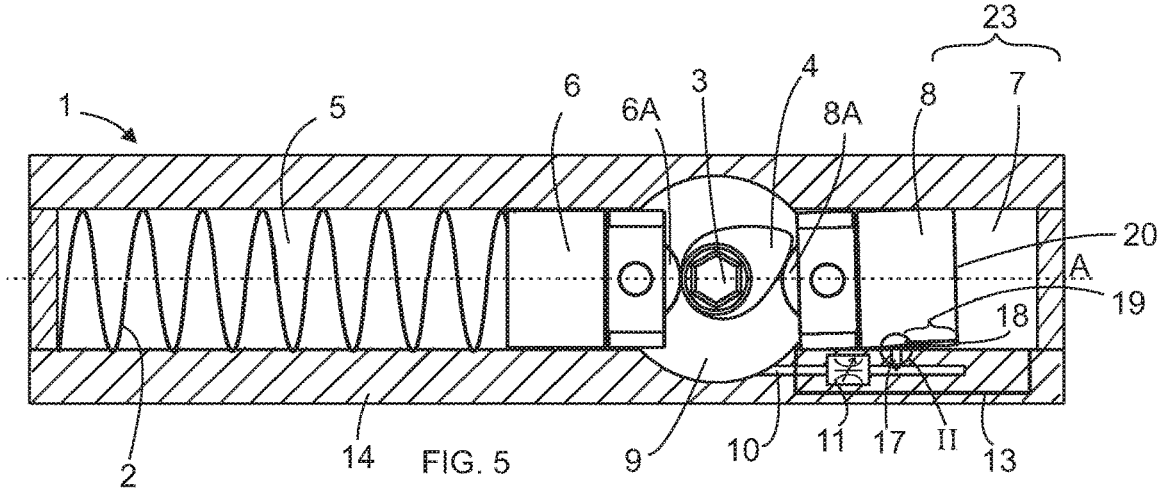

| | | | | |
|---|---|---|---|---|
| 7,421,761 | B2 * | 9/2008 | Johnson | E05F 3/104 16/52 |
| 7,966,771 | B2 * | 6/2011 | Bienek | E05F 3/104 49/340 |
| 8,779,713 | B2 * | 7/2014 | Burris | E05F 15/70 318/466 |
| 9,790,723 | B2 * | 10/2017 | Bienek | E05F 3/104 |
| 10,370,885 | B1 * | 8/2019 | Kondratuk | E05F 3/14 |
| 2007/0033768 | A1 * | 2/2007 | Ginzel | E05F 3/04 16/71 |
| 2008/0022490 | A1 * | 1/2008 | Ginzel | E05F 15/611 16/51 |
| 2008/0042330 | A1 * | 2/2008 | Karkkainen | E05F 3/12 267/127 |
| 2008/0127562 | A1 * | 6/2008 | Bienek | E05F 3/223 49/334 |
| 2011/0197391 | A1 * | 8/2011 | Yu | E05F 3/104 16/51 |
| 2012/0117755 | A1 * | 5/2012 | Walhorn | E05F 3/104 16/66 |
| 2012/0210647 | A1 * | 8/2012 | McKibben | E05F 1/105 49/340 |
| 2012/0272475 | A1 * | 11/2012 | Bienek | E05F 3/223 16/51 |
| 2013/0000074 | A1 * | 1/2013 | Bienek | F16K 31/0627 16/53 |
| 2013/0081227 | A1 * | 4/2013 | Hensh | E05F 3/104 16/53 |
| 2019/0264486 | A1 * | 8/2019 | Toloday | E05F 3/102 |
| 2021/0230921 | A1 * | 7/2021 | Battlogg | E05F 3/12 |
| 2021/0277697 | A1 * | 9/2021 | Juntunen | E05F 3/12 |

* cited by examiner

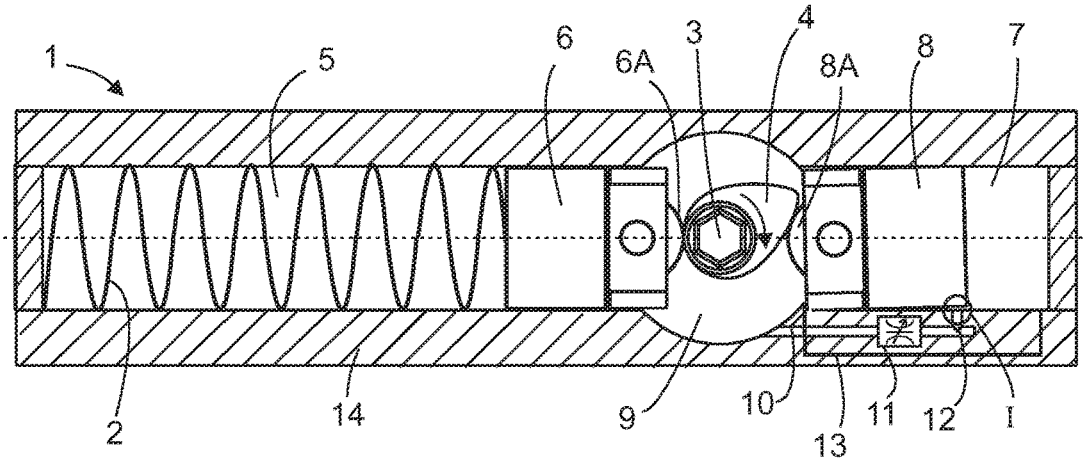
FIG. 1
FIG. 2
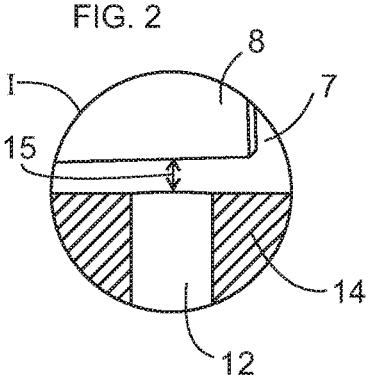
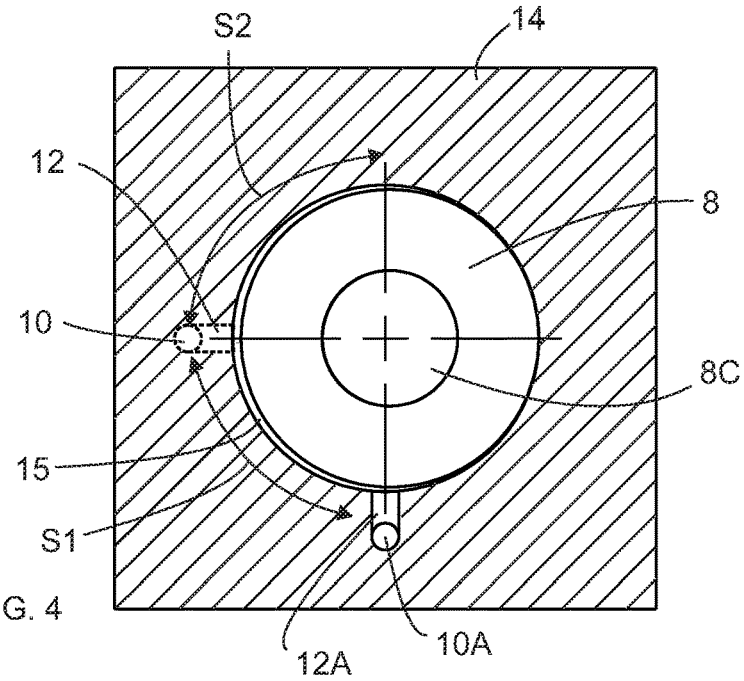
FIG. 4
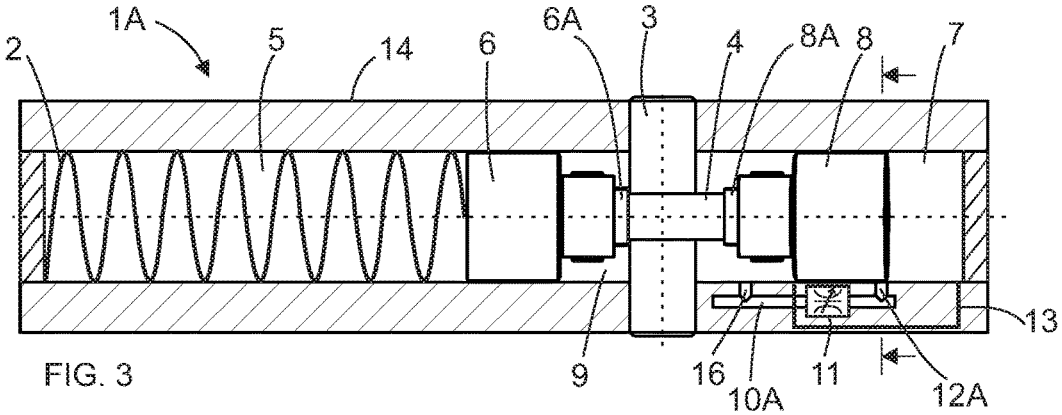
FIG. 3

CAM ACTION DOOR CLOSER

FIELD OF TECHNOLOGY

The invention relates to a cam action door closer.

PRIOR ART

A cam action door closer comprise a cam that is connected to the axis of the door closer. The axis is connectable to an arm, which in turn is connectable to a door. So, when being installed the door closer can close the door after the opening of the door. Opening the door, a spring inside the door closer is becoming tense. At the same time the axis and the cam turn. Pistons inside the door closer move also. When door is released the potential energy of the spring pushes the pistons back, turns the axis and the cam, and closes the door.

FIG. 1 shows a known cam action door closer 1. The door closer has a body 14. The body has a bore that is divided into three spaces by pistons in the bore. The first space is 5 is for a spring 2 that is tensioned when the door is opened. The spring is in connection with a closing piston 6. The piston is in connection with a cam 4 that is connected to an axis 3. The axis and the cam are located in the second space 9.

On the other side of the axis 3 there is a closing control piston 8 that is also in connection with the cam 4. As can be seen in the figure the pistons may have rollers 6A, 8A being in connection with the cam 4 in order to make the turning of the cam smoother. The closing control piston is between the second space and the third space 7. The body 14 has also a speed control channel system 10, 12 and a latching control channel system 13 in order to provide paths for oil inside the second and third spaces. So the cam action door closer has oil inside. The speed control channel system is used with a closing speed valve 11 in order to adjust a closing speed for the door. The adjustment is made with the door opening angles 180-10 degrees. The end phase of the door closing between 10-0 degrees is handled by the latching control channel system 13 and a latching control valve (not shown in the figure).

When the piston head of the closing control piston 8 covers the speed connecting channel 12 of the speed control channel system the door is open 10 degrees, and the oil from the third space 7 starts to flow through the latching control channel system 13. This happens when the spring pushes the closing piston 6, which in turn pushes the cam, and the cam pushes the closing control piston in order to close the door. However, since the cam 3 turns for pushing the closing control piston 8 also turns in the bore of the door closer. It means that the speed connecting channel 12 is not closed properly since the clearance is too large than designed some oil still flows through the speed control channel system 10, 12 to the second space 9. FIG. 2 illustrates the effect of the tilting of the closing control piston 8. This tilting affects malfunctions when the door closer closes the door. The door is not closed as it should be. The latching/braking effect is not good enough.

SHORT DESCRIPTION

The object of the invention is to alleviate or even eliminate the problem said above. The object is achieved in a way described in the independent claims. Dependent claims illustrate different embodiments of the invention.

A cam action door closer according to the invention comprises a body, a spring, a speed control channel system and a latching control channel system, and a closing control piston having a piston head and a circular side. The closing control piston has a cutting on the side of the closing control piston and on the piston head. The cutting forms a control edge at its end, and the cutting has a length between the piston head and the control edge. The speed control channel system comprises a speed control channel and a speed connecting channel. The speed connecting channel is located in such a way that the control edge is arranged to close it when the closing control piston 8 is moved by the spring to close a door.

LIST OF FIGURES

Figure 6:
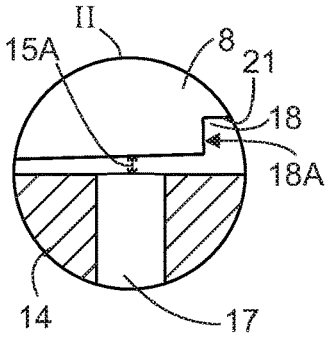
Figure 8:
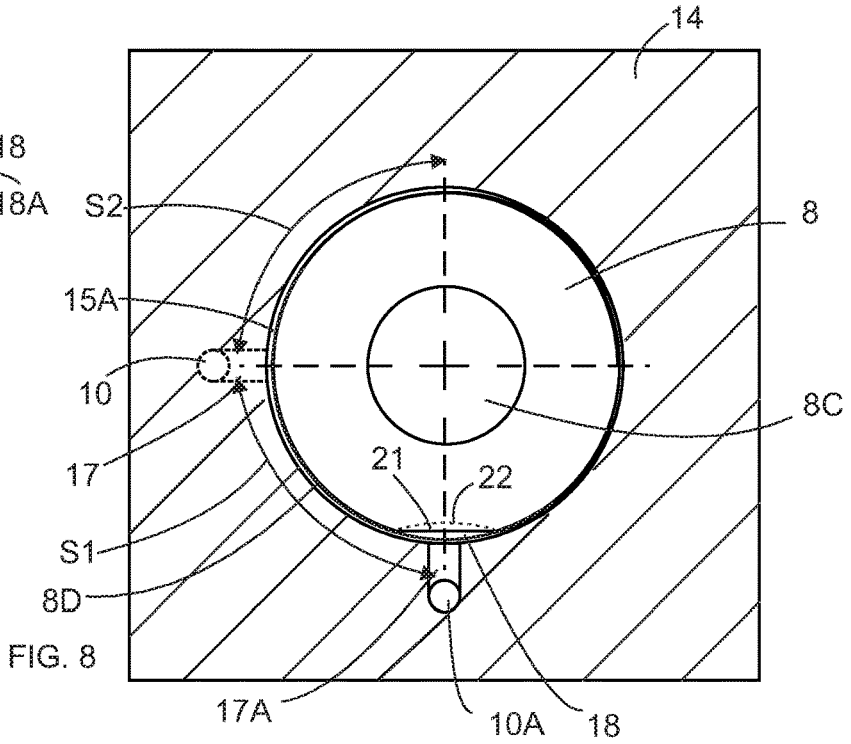
Figure 7:
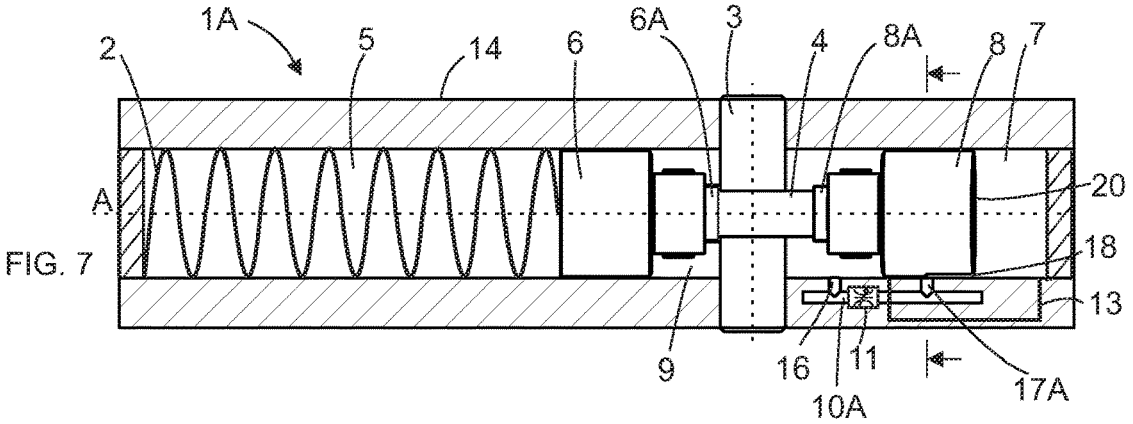

In the following, the invention is described in more detail by reference to the enclosed drawings, where FIG. 1 illustrates an example of a prior art cam action door closer, FIG. 2 illustrates a detail view of FIG. 1, FIG. 3 illustrates another example of a prior art cam action door closer, FIG. 4 illustrates a cross section view of FIG. 3, FIG. 5 illustrates an example of a cam action door closer according to the invention, FIG. 6 illustrates a detail view of FIG. 5, FIG. 7 illustrates another example of a cam action door closer according to the invention, and FIG. 8 illustrates a cross section view of FIG. 7,

DESCRIPTION OF THE INVENTION

All figures are schematic figures, so they do not show all features of real cam action door closers. The features shown in the figures are for illustrating the invention.

Referring further to FIG. 1 the latching control channel system 13 is illustrated only schematically and without the latching control valve. The speed control valve 11 is also illustrated schematically. FIG. 2 shows how the tilting of the closing control piston 8 can increase the clearance 15 between the closing control piston 8 and the body 14 (and the speed connecting channel 12). As said, when the closing control piston 8 moves during the closing of the door, the oil in the third space 7 can still move to the second space 9 via the channel 10 and the speed connecting channel because of the tilting. This is not a desired functioning.

FIG. 3 shows another example of the prior art cam action door closer wherein the speed control channel system 10A, 12A and the latching control channel system 13 are located in another positions than in FIG. 1, namely 90 degrees from the positions of FIG. 1 and in relation to the longitudinal axis of the door closer. FIG. 4 shows a cross sectional view of FIG. 3 at the location of the speed connecting channel 12A. FIG. 4 illustrates also the position of the speed connecting channel 12 of FIG. 1 as dashed lines. As can be noted the cross sectional view illustrates how the clearance 15 exists and how the position of the speed connecting channel affects to the undesired flow mentioned above. When the speed connecting channel 12 is situated as shown in FIG. 1 the clearance allows relatively huge undesired oil flow via the channel 12. When the connecting channel 12A is situated as shown in FIG. 3 the clearance allows also undesired oil flow via the connecting channel 12, but the oil flow is not so large than in FIG. 1. In the both cases the oil flow via the connecting channel 12 is undesirable and the oil should be flow via the latching control channel 13 (shown only schematically).

In FIG. 4 it can be also seen that the speed connecting channel can be situated to any position between the positions shown in the figure i.e. in a sector S1. The connection channel is also possible to situate in another sector S2, which is the sector above sector S1 in FIG. 1. These sectors cover the side of the door closer where the clearance increases due to the tilting of the closing control piston 8. On the other side the tilting decreases the clearance, and the oil flows normally through the latching control channel 13 when the door closer closes the door. However, undesired wearing of the bore and the closing control piston occurs.

FIG. 5 illustrates an example of a cam action door closer according to the invention. FIG. 7 illustrates another example of a cam action door closer according to the invention.

A cam action door closer according to the invention comprises a body 14, a spring 2, a speed control channel system 10, 17 and a latching control channel system 13, and a closing control piston 8 having a piston head 20 and a circular side. The closing control piston 8 has a cutting 18 on the side of the closing control piston and on the piston head as shown in the figures. The cutting 18 forms a control edge 18A at its end. The cutting has a length 19 between the piston head and the control edge.

The speed control channel system comprises a speed control channel 10 and a speed connecting channel 17. The speed connecting channel is located in such a way that the control edge 18A is arranged to close it when the closing control piston 8 is moved by the spring 2 to close a door.

Due to the length 19 of the cutting the controlling edge of the closing control piston 8 is in more middle of the piston and not on the piston head 20. Therefore the tilting of the piston 8 does not form so large clearance 15A. See FIG. 6 that shows a detail view of the FIG. 5. The length of the cutting 18 affects to the clearances, the longer length 19, the smaller clearance.

The other embodiment of the FIG. 7 shows different positions for the speed control channel system 10A, 12A and the latching control channel system 13, namely 90 degrees from the positions of FIG. 5 and in relation to the longitudinal axis of the door closer.

FIG. 8 shows a cross sectional view of FIG. 7 at the location of the speed connecting channel 17A. FIG. 8 illustrates also the position of the speed connecting channel 17 of FIG. 5 as dashed lines. As can be noted the cross sectional view illustrates how the clearance 15 exists and how the position of the connecting channel affects to the clearance between the connecting channel and the piston 8. As can be noted the clearance is mush smaller at both locations of the connecting channel 17, 17A. It means that the oil has not so much room to flow via the speed control channel system, and therefore the oil flows more easily via the latching control channel system 13 as desired.

It can also be noted that the side of the door closer where the clearance increases due to the tilting of the closing control piston 8 the clearance does not change very much between different locations on the circular side of the piston 8. In FIG. 8 it can be also seen that the speed connecting channel can be situated to any position between the positions shown in the figure i.e. in a sector S1. The connection channel is also possible to situate in another sector S2, which is the sector above sector S1 in FIG. 1. It worth mentioning that the speed connecting channel could also be located on the side of the door closer. The closing control piston 8 has also a space 8C in the middle, as shown in FIG. 8, but it is not relevant for the invention.

So, when the closing control piston 8 is moved by the spring 2 for closing the door and when the control edge 18A closes the speed connecting channel 17 oil that is inside the door closer at the side of piston head 20 (i.e. in the third space 7) is arranged to flow to another side of the closing control piston 8 (i.e. to the second space 9) via the latching control channel system 13. In other words, in a moment when the speed connecting channel 17 is closed the oil flow to the second space 8 changes to flow through the latching control channel system.

FIG. 8 illustrates also alternatives to perform the cutting 18. The cutting 18 can be formed as a flat surface 21 on the side of the closing control piston 8. Another possible embodiment is that the cutting 18 is formed to have a concave surface 22 on the side of the closing control piston 8. The concave may help that the oil flows more easily via the speed control channel system before the control edge 18A closes the speed connecting channel 17.

The invention makes it also possible to manufacture the cam action door closer without a piston/bore seal. The use of a piston/bore seal for handling the tilting problem would increase the manufacturing costs. Any case the piston/bore seal may still be used with the inventive arrangement.

When manufacturing the door closer and making the bore inside, it has also been noted that due to the challenges in manufacturing it is very difficult or even impossible to obtain a completely circular bore in a range 23 near the mouth/end of the bore. So, the circularity and the diameter of the bore is usually not fully circular near the end of the bore. By using the invention the speed connecting channel 17 can be situated outside the range 23 near the mouth/end of the bore wherein the bore is considered to be circular (taking into account manufacturing tolerances), i.e. closer to the axis 3 of the door closer. In prior art solutions the speed connecting channel is usually in the said range near the mouth/end of the bore.

In the invention the latching/braking effect is the same despite of the installation method. So, the cam rotation direction has no influence to the user experience.

As can seen from the examples in this description the channels and valves with the channels can be situated in different positions. It is evident from the above that the invention is not limited to the embodiments described in this text but can be implemented in many other different embodiments within the scope of the independent claims.

The invention claimed is:

1. A cam action door closer comprising:
- a body;
- an axis;
- a cam connected to the axis;
- a speed control channel system, comprising:
  - a speed control channel; and
  - a speed connecting channel;
- a latching control channel system;
- a closing control piston, comprising:
  - a piston head;
  - a circular side; and
  - a cutting extending along an outer side of the closing control piston and on the piston head, the cutting forming a control edge at an end of the cutting, and the cutting having a length extending from an outer edge of the piston head to the control edge;
- a spring disposed on another side with respect to the axis than the closing control piston,
- wherein the speed connecting channel is located such that the control edge is arranged to close the speed connecting channel it when the closing control piston is moved by the spring via a cam to close a door.

2. The cam action door closer according to claim 1, wherein when the closing control piston is moved by the spring for said closing and when the control edge closes, speed connecting channel oil that is inside the door closer at the side of piston head is arranged to flow to another side of the closing control piston via the latching control channel system.

3. The cam action door closer according to claim 1, wherein the cutting forms a flat surface on the side of the closing control piston.

4. The cam action door closer according to claim 1, wherein the cutting forms a concave surface on the side of the closing control piston.

* * * * *